US007491126B2

(12) United States Patent
Jung

(10) Patent No.: US 7,491,126 B2
(45) Date of Patent: Feb. 17, 2009

(54) EXPANDABLE BATON FOR SELF-PROTECTION

(76) Inventor: Jae Sul Jung, 607-1406, Jangmi Apt, Hagye 2(i)-dong, Nowon-gu, Seoul (KR)

( * ) Notice: Subject to any disclaimer, the term of this patent is extended or adjusted under 35 U.S.C. 154(b) by 154 days.

(21) Appl. No.: 11/505,401

(22) Filed: Aug. 17, 2006

(65) Prior Publication Data

US 2007/0042825 A1 Feb. 22, 2007

(30) Foreign Application Priority Data

Aug. 17, 2005 (KR) ..... 20-2005-0023686 U

(51) Int. Cl.
*F41B 15/02* (2006.01)

(52) U.S. Cl. ..... 463/47.7; 135/75

(58) Field of Classification Search ..... 463/47.2, 463/47.7; 135/68–70, 72, 75; 403/326, 329, 403/377

See application file for complete search history.

(56) References Cited

U.S. PATENT DOCUMENTS 3,507,528 A * 4/1970 Desmarchais ..... 403/182
4,037,839 A * 7/1977 Nelson ..... 463/47.7
4,819,137 A * 4/1989 Hamilton ..... 362/102
4,982,960 A * 1/1991 David ..... 463/47.6
5,031,827 A * 7/1991 von Braunhut ..... 231/3
5,160,140 A * 11/1992 Starrett ..... 463/47.6
5,961,387 A * 10/1999 Parsons ..... 463/47.7
6,238,292 B1 * 5/2001 Pelkey ..... 463/47.7
6,782,903 B1 * 8/2004 Jarman et al. ..... 135/75

* cited by examiner

*Primary Examiner*—William M Pierce
(74) *Attorney, Agent, or Firm*—Morgan Lewis & Bockius LLP

(57) ABSTRACT

The present invention relates to a baton for self-protection is composed of a cylindrical handle, a locking piece, a switch, a first telescoping rod, a second telescoping rod, and a spring. The handle is covered by a grip. The locking piece is coupled to the center portion of a locking piece fixing section inserted into one end of the handle and has a locking projection provided in predetermined positions of both ends thereof. The switch is mounted in the rear side of the locking piece fixing section. The first telescoping rod has a widened portion and tapered portion formed in both ends thereof so as to be telescoped inside the handle. The second telescoping rod is housed in the first telescoping rod, and a step portion of the second telescoping rod at one end thereof is closely coupled to the locking projection of the locking piece. The spring is mounted in the handle so as to elastically support the first and second telescoping rods.

4 Claims, 7 Drawing Sheets

[FIG. 1]
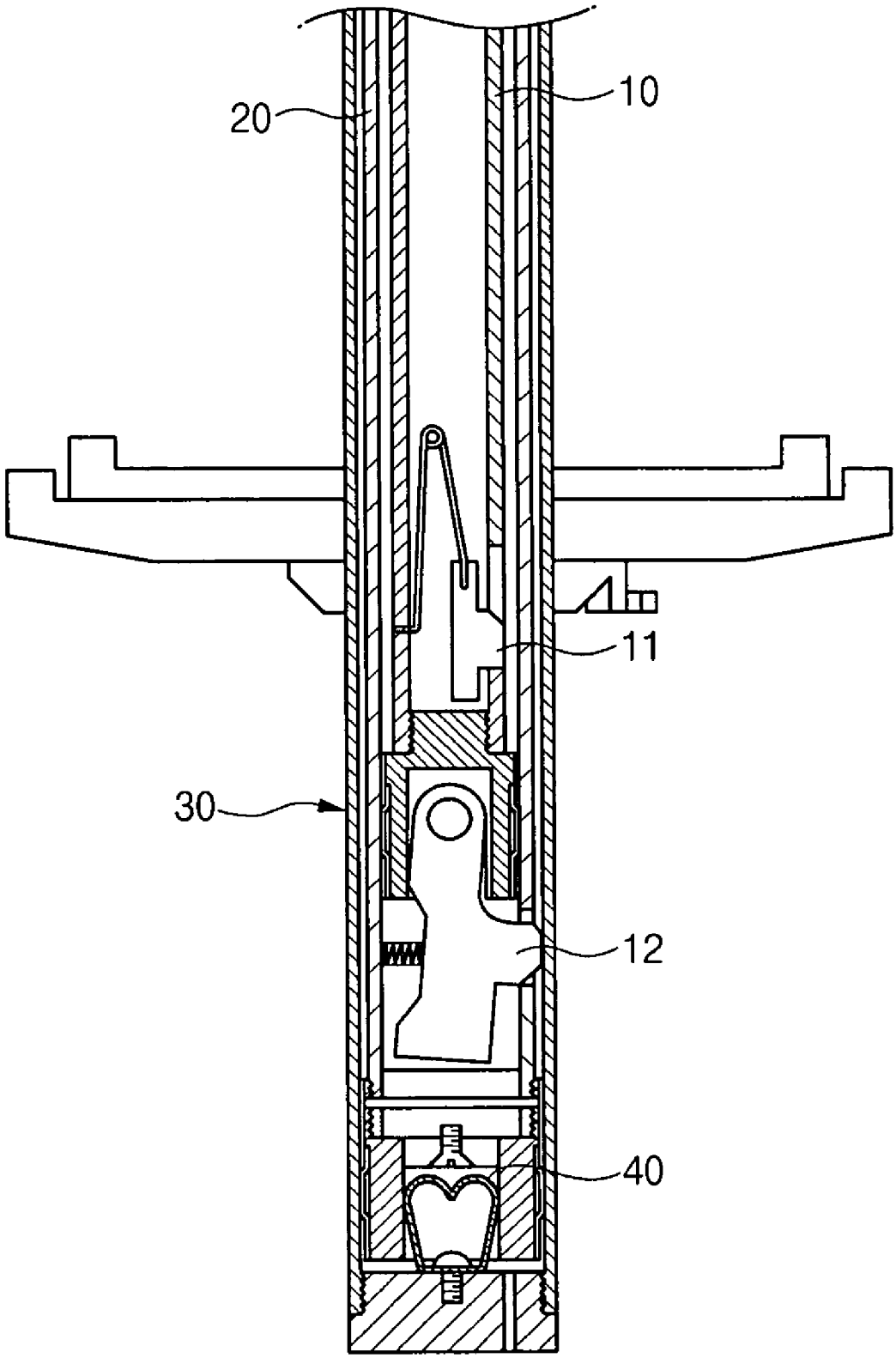

[FIG. 2]
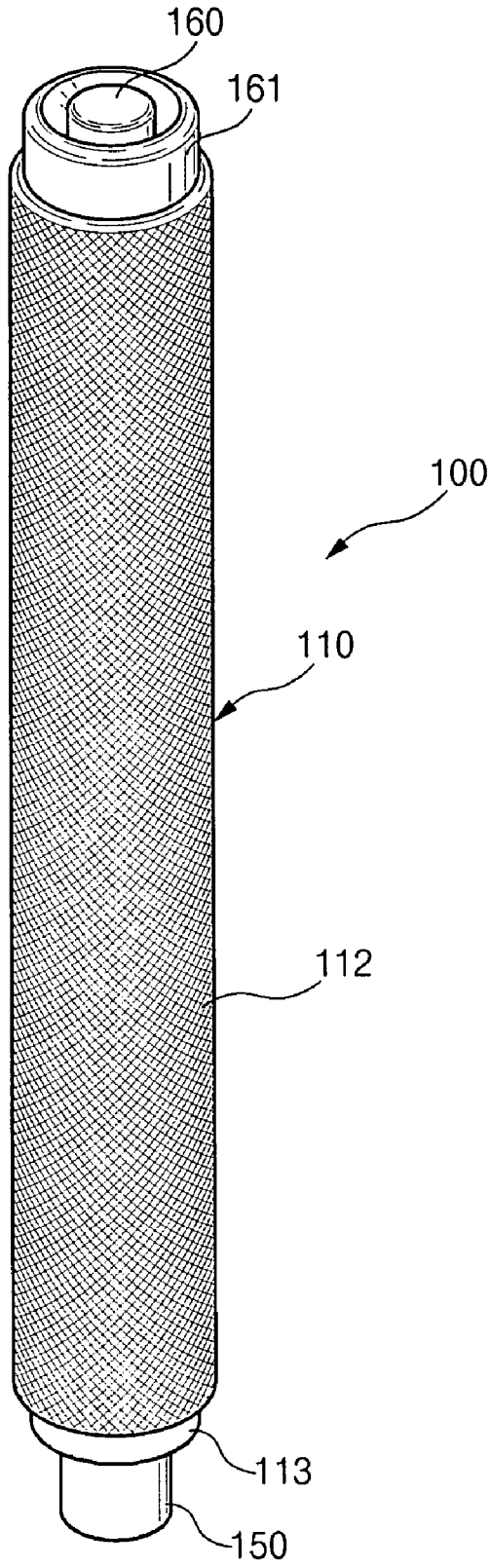

[FIG. 3A]
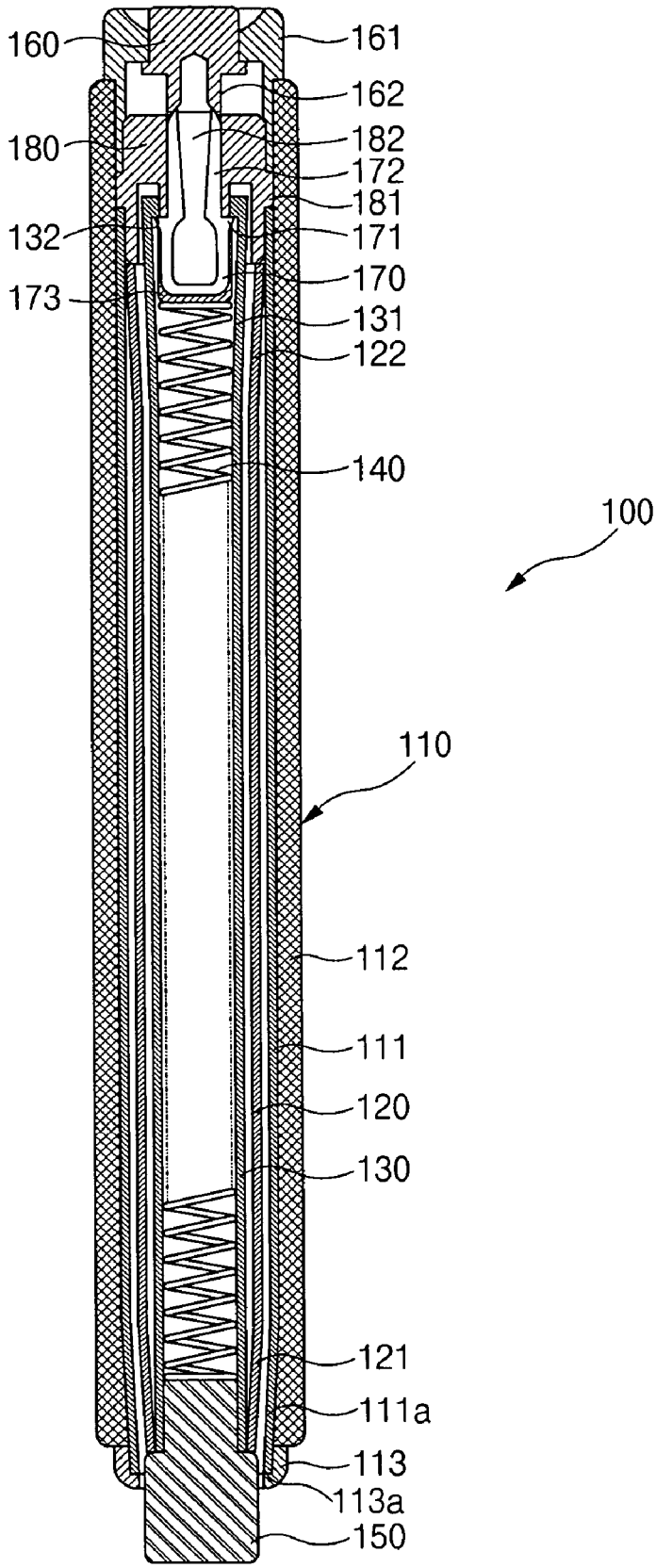

[FIG. 3B]
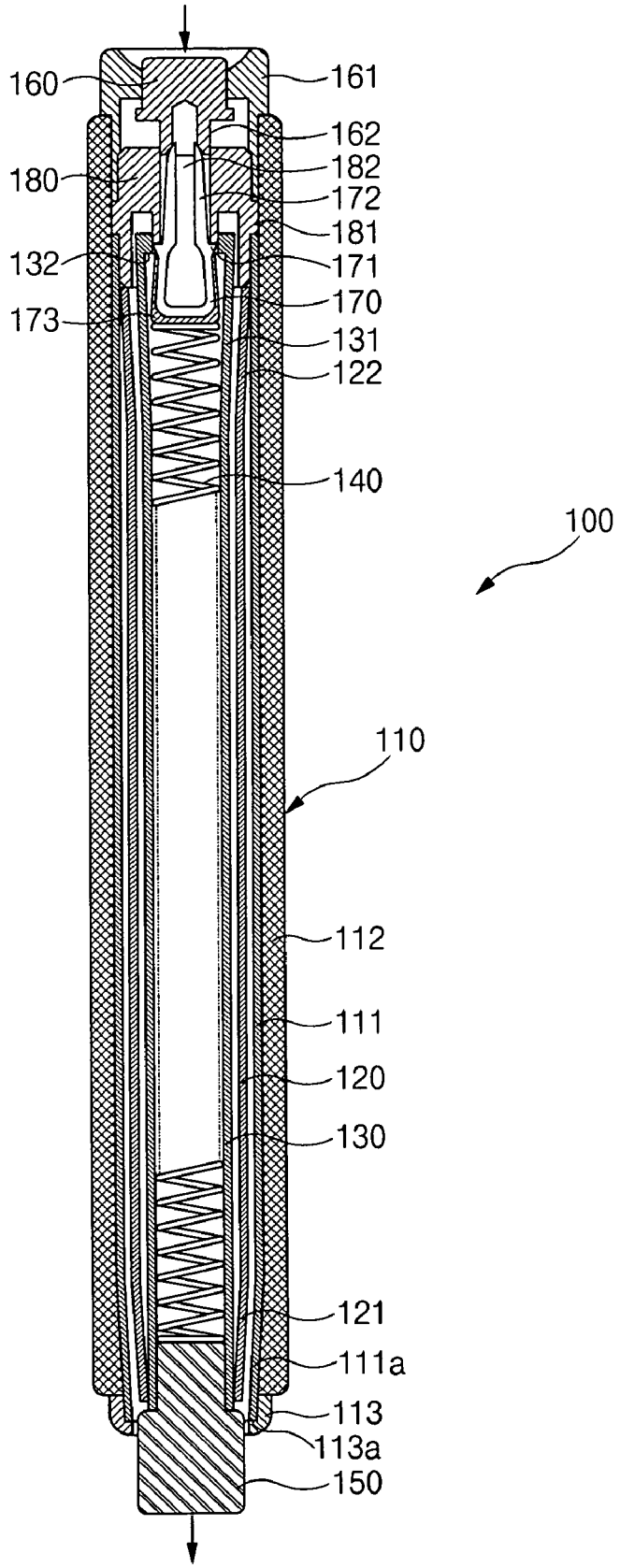

[FIG. 4]
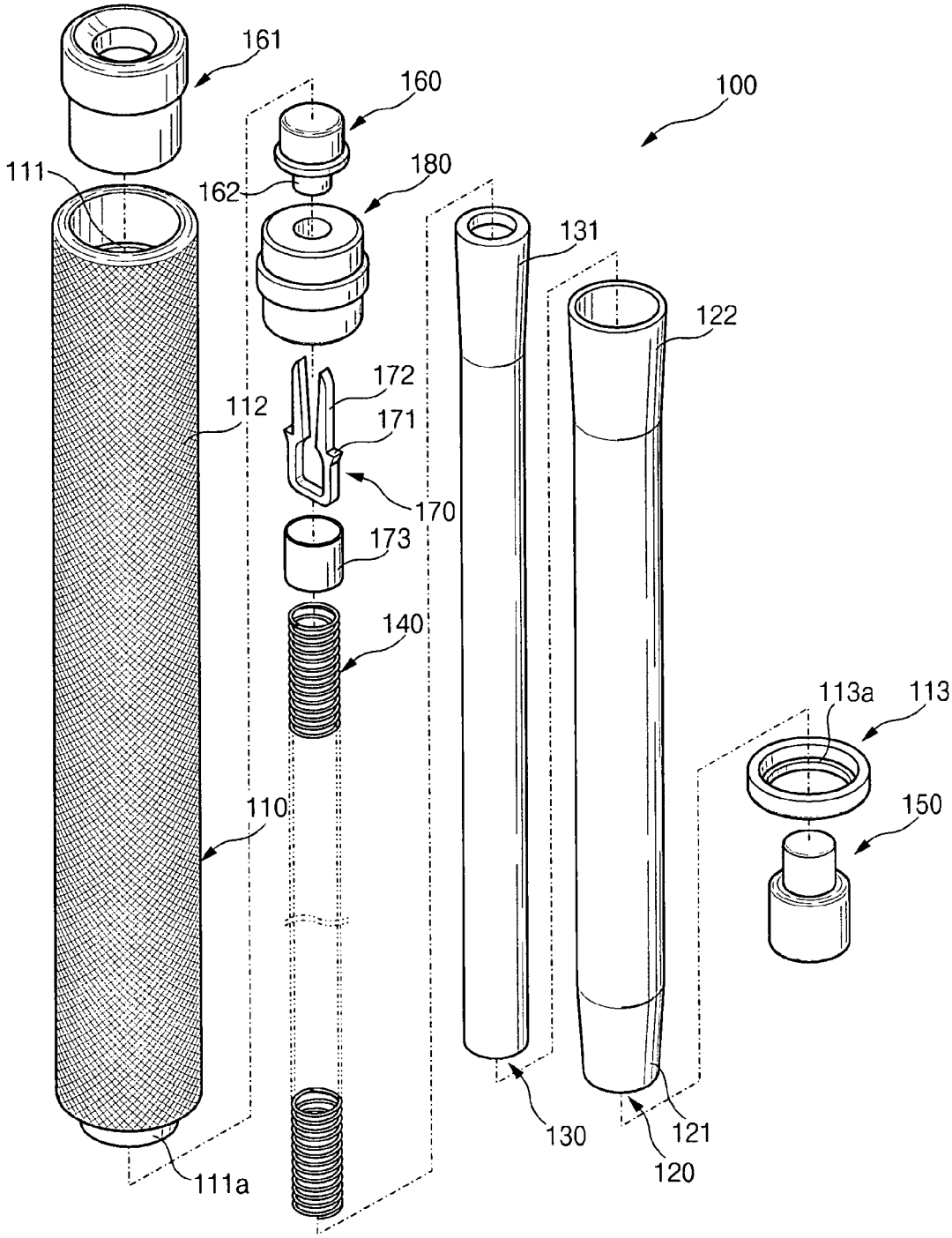

[FIG. 5]
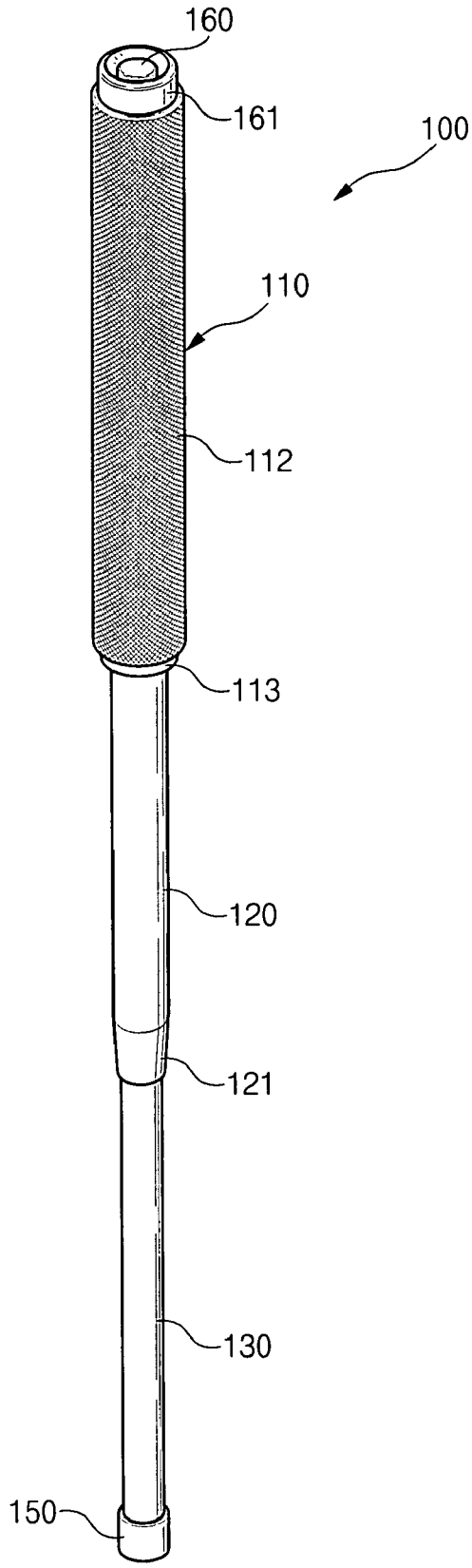

[FIG. 6]
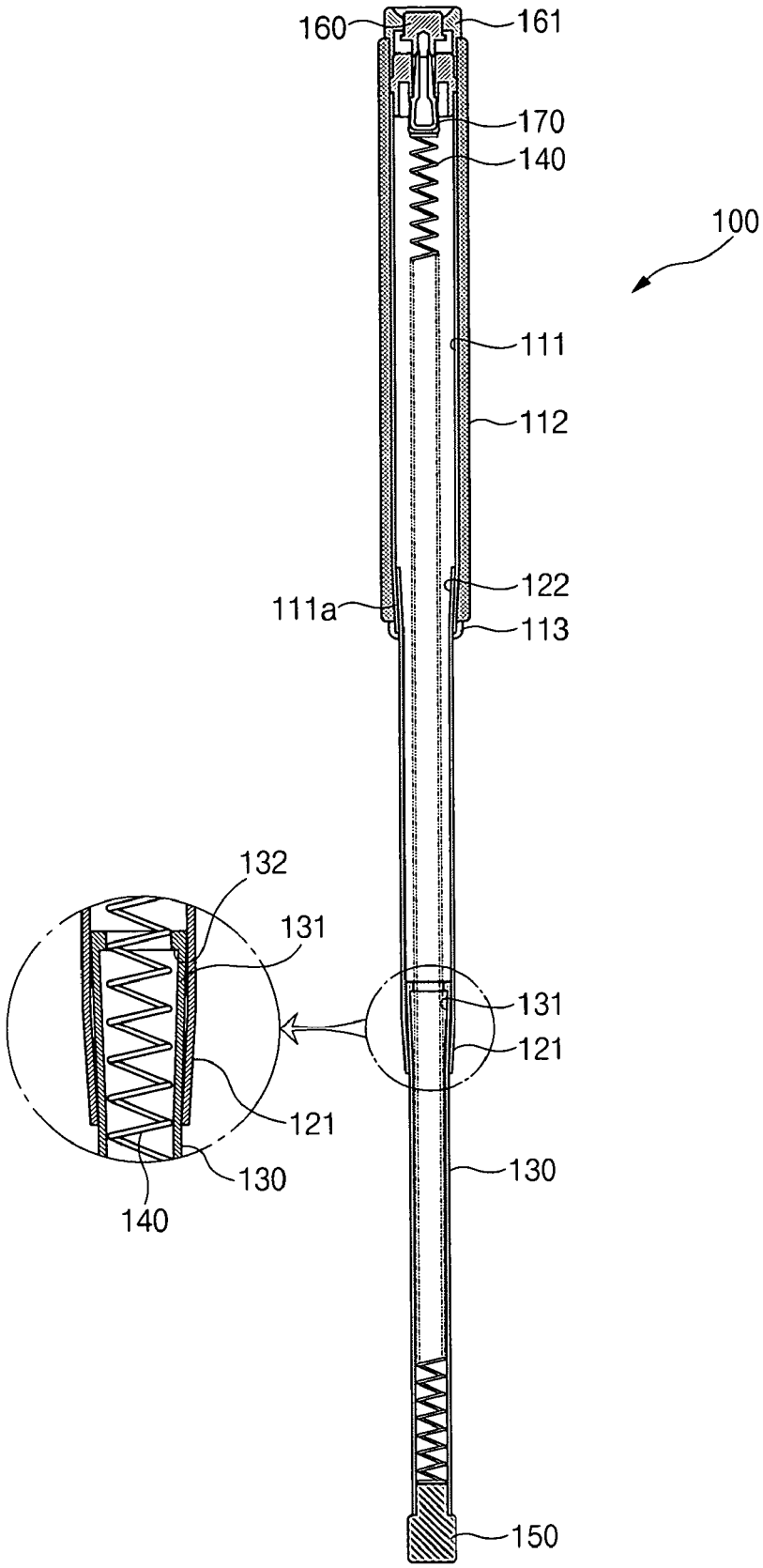

EXPANDABLE BATON FOR SELF-PROTECTION

CROSS-REFERENCE TO RELATED APPLICATIONS

The application claims the benefit of Korea Patent Application No. 2005-0023686 filed with the Korea Intellectual Property Office on Aug. 17, 2005, the disclosure of which is incorporated herein by reference.

BACKGROUND OF THE INVENTION

1. Field of the Invention

The present invention relates to an expandable baton for self-protection. In the expandable baton for self-protection, multiple telescoping rods which are elastically coupled to each other inside a cylindrical handle are elastically expanded by a switch operation so that the expandable baton is enlarged. Therefore, the expandable baton can be used for self-protection in an emergency and can be conveniently carried in the retracted state at normal times.

2. Description of the Related Art

Recently, as various violent crimes for unspecific persons increase, various self-protection tools are being developed. Particularly, women buy and use various self-protection tools such as a stun gun and gas gun.

However, the self-protection tools such as a stun gun and gas gun are composed of a complex mechanic device. Therefore, it is inconvenient for women to carry them because they are heavy in comparison with the size thereof. Further, when the mechanic device malfunctions or is taken by the opposite person in an emergency, it can be used as another weapon of violent crimes.

Therefore, various batons for self-protection have been developed, which can be easily used by women, can be carried in the retracted state, and can be expanded in a longitudinal direction in an emergency so as to be used as a self-protection tool. Batons for self-protection, which have been developed in the initial stage, have such a structure that multiple telescoping rods are simply stacked and coupled inside a handle. Therefore, whenever a user uses the baton, the telescoping rods should be drawn out by hand. Alternately, when a user flourishes the baton, the telescoping rods are expanded by the inertia of his/her arm.

The construction of the conventional baton for self-protection has been disclosed in Korea Utility Model Registration No. 317338, and a schematic structure thereof will be described as follows.

FIG. 1 is a sectional view of the conventional baton for self-protection in the retracted position. As shown in FIG. 1, the baton for self-protection has such a structure that a tip-end rod 10 and an intermediate rod 20 are sequentially housed in a handle rod 30. At normal times, the baton for self-protection can be carried by retracting the three-stage rods. When the baton for self-protection is expanded for use, a force is applied to a direction where the baton is brought down with the handle rod 30 being held, so that the intermediate rod 20 and the tip-end rod 10 are extracted from the handle rod 30.

In this case, an elasticity supporting piece is fixed to a handle lid spirally coupled to the handle rod by a screw. Between the elasticity supporting piece and the inner surface of the handle rod, base portions of the tip-end rod 10 and the intermediate rod 20 are elastically locked so that the fixed state is maintained.

Further, when the conventional baton for self-protection is expanded, the tip-end rod 10 and the intermediate rod 20 are sequentially extracted from the handle rod 30 and are supported by levers 11 and 12, so that the expanded state is maintained.

In the conventional baton for self-protection having such a structure, the elasticity of the elasticity maintaining piece can be lost, the elasticity maintaining piece bringing the end portions of the tip-end and intermediate rod 10 and 20 in close contact with the inner surface of the handle rod 30. In this case, since the tip-end and intermediate rods 10 and 20 cannot be fixed inside the handle rod 30, they moves inside the handle rod 30 due to self-weight, which makes it impossible to retract the baton to the minimum size.

If an elastic strength of the elasticity maintaining piece is set to be larger than a predetermined range when the baton for self-protection is manufactured, the ends of the tip-end and intermediate rods 10 and 20 are not taken off between the elasticity maintaining piece and the inner surface of the handle rod 30, so that the tip-end and intermediate rods 10 and 20 cannot be reliably drawn out in an emergency.

Another baton for self-protection having a similar structure has been disclosed in U.S. Pat. Publication No. 6,056,643. The baton for self-protection has a similar problem.

In order to solve such a problem, a baton for self-protection having an improved structure has been disclosed in Korea Patent Publication No. 2002-66239. In the baton for self-protection, a switching unit formed of an elastic member is elastically provided across a holding section at the leading end of a hollow tube body and a flexible tube, and the flexible tube is telescoped inside the hollow tube body by an elastic force. The baton for self-protection is automatically expanded by the switching unit.

However, the appearance of the baton for self-protection is not beautiful because the hollow tube body of the switching unit is exposed outside. Further, a plurality of components such as a pressing button, a leaf spring, a fastening pin, a locking member and the like, composing the switching unit, are assembled in a complex manner, thereby increasing a manufacturing cost. The size of the baton for self-protection inevitably increases because the components of the switching unit are assembled so as to be exposed outside. Furthermore, as constituting members as well as the switching unit are repeatedly driven, the locking force in the assembled portion is weakened so that a breakdown rate increases.

SUMMARY OF THE INVENTION

An advantage of the present invention is that it provides an expandable baton for self-protection in which a locking piece is mounted inside one end of a cylindrical handle, one end of a telescoping rod is fixed by a locking projection of the locking piece, and the locking piece is caused to elastically move by a switch mounted in the rear side thereof so that multiple telescoping rods supported by a spring are elastically drawn out. Therefore, the expandable baton for self-protection can be conveniently carried in the retracted state at normal times, and can be automatically expanded by a simple switch operation in an emergency.

Additional aspects and advantages of the present general inventive concept will be set forth in part in the description which follows and, in part, will be obvious from the description, or may be learned by practice of the general inventive concept.

According to an aspect of the invention, a baton for self-protection is composed of a cylindrical handle, a locking piece, a switch, a first telescoping rod, a second telescoping rod, and a spring. The handle is covered by a grip. The locking piece is coupled to the center portion of a locking piece fixing section inserted into one end of the handle and has a locking projection provided in predetermined positions of both ends thereof. The switch is mounted in the rear side of the locking piece fixing section. The first telescoping rod has a widened portion and tapered portion formed in both ends thereof so as to be telescoped inside the handle. The second telescoping rod is housed in the first telescoping rod, and a step portion of the second telescoping rod at one end thereof is closely coupled to the locking projection of the locking piece. The spring is mounted in the handle so as to elastically support the first and second telescoping rods.

The handle is composed of a steel rod of which both ends are opened, and the outer circumference of the steel rod is covered by the grip formed of synthetic resin including rubber. Through one opening of the steel rod, the locking piece fixing section having the locking piece inserted therein is mounted.

The locking piece has a pair of elastically-moving sections formed by cutting the center portion thereof. As the switch engaged with the ends of the elastically-moving sections is pressed, the elastically-moving sections elastically move, so that the end of the second telescoping rod fixed to the locking projections of both sides of the locking piece is released.

At this time, the second telescoping rod is caused to advance to the front side of the handle by an elastic force of the spring so as to be drawn outside the handle. Simultaneously, a widened portion having the step portion locked to the locking projection of the locking piece comes in surface contact with the tapered portion of the first telescoping rod.

The first and second telescoping rods drawn outside the handle are retracted into the handle by an external force applied in a direction reverse to a direction where the first and second telescoping rods are drawn out. If an external force larger than an elastic force of the spring is applied through the tip coupled to the end of the second telescoping rod, the step portion of the second telescoping rod is engaged with the locking projection of the locking piece, so that the first and second telescoping rods are retracted and fixed.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a sectional view of a conventional expandable baton for self-protection in the retracted position;

FIG. 2 is a perspective view of an expandable baton for self-protection of the present invention in the retracted position;

FIGS. 3A and 3B are sectional views of the expandable baton for self-protection of the invention in the retracted position, FIG. 3A being a sectional view showing a state where a locking piece of a second telescoping rod is locked and FIG. 3B being a sectional view showing a state where the locking piece of the second telescoping rod is released;

FIG. 4 is an exploded perspective view of the expandable baton for self-protection according to the invention;

FIG. 5 is a perspective view of the expandable baton for self-protection in the expanded position; and FIG. 6 is a sectional view of the expandable baton for self-protection in the expanded position.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, the technical construction and operational effect of an expandable baton for self-protection according to the present invention will be described in detail with reference to the accompanying drawings.

FIG. 2 is a perspective view of an expandable baton for self-protection of the present invention in the retracted position. FIGS. 3A and 3B are sectional view of the expandable baton for self-protection in the retracted position. FIG. 3A is a sectional view showing a state where a locking piece of a second telescoping rod is locked, and FIG. 3B is a sectional view showing a state where the locking of the locking piece of the second telescoping rod is released. FIG. 4 is an exploded perspective view of the expandable baton for self-protection.

As described in the drawings, the expandable baton 100 for self-protection according to the invention is composed of a cylindrical handle 110, first and second telescoping rods 120 and 130, a locking piece 170, and a pressing switch 160. The upper and lower ends of the handle 110 are opened. The first and second telescoping rods 120 and 130 are elastically supported by a spring 140 mounted on the center portion of the handle 110 and are inserted into the handle 110 so as to be slidably transferred in a longitudinal direction thereof. The locking piece 170 is mounted on the center portion of a locking piece fixing section 180 so as to elastically move, the locking piece fixing section 180 being inserted through the upper opening of the handle 110. Further, the locking piece 170 has a locking projection 171 formed in both sides such that the insertion-side end of the second telescoping rod 130 is locked thereto. The switch 160 is mounted on the upper portion of the locking piece fixing section 170 and is surrounded by a switch cap 161 projecting above the upper portion of the handle 110.

The handle 110 is composed of a steel baton 111 formed of the same material as the first and second telescoping rods 120 and 130. The outer circumference of the steel baton 111 is covered with a grip 112. On the lower end of the grip 112, a circular ring 113 is bonded and fixed so as to cover the steel baton 111 exposed outside the grip 112 and to prevent the steel baton 111 from coming off.

The lower end of the steel baton 111 comes in close contact with a step portion 113 provided in the lower inner circumference of the ring 113. The steel baton 111 has a cylindrical tapered portion 111*a* formed in the lower portion thereof. The diameter of the tapered portion 111*a* becomes gradually small toward the end thereof.

The grip 112 covering the steel baton 111 is composed of synthetic resin including rubber with a high friction coefficient. The lower portion of the grip 112 is formed to be gradually thick along the tapered portion 111*a* so as to come in close contact with the lower portion of the steel baton 111.

Instead of the ring 113 bonded and fixed to the lower end of the grip 112, a step portion may be provided by integrally extending the lower end of the grip 112 to the lower end of the steel baton 111, thereby playing a roll of the ring 113 separately coupled to the grip 112. Then, it is possible to achieve the simplification of manufacturing.

The first and second telescoping rods 120 and 130, which are inserted into the steel baton 111 of the handle 110, are formed to have a different diameter so as to be sequentially telescoped on the inner circumference of the steel baton 111. The first telescoping rod 120 is provided with a widened portion 122 and a tapered portion 121, which are respectively formed at both ends thereof. The diameter of the widened portion 122 becomes gradually large, and the diameter of the tapered portion 121 becomes gradually small. When the first telescoping rod 120 is elastically drawn out from the handle 110, the outer circumference of the upper widened portion 122 comes in surface contact with the inner circumference of the lower tapered portion 111*a* such that the first telescoping rod 120 is fixed.

The second telescoping rod 130 is slidably transferred inside the first telescoping rod 120. The upper portion of the second telescoping rod 130 is formed with a widened portion 131 which is engaged with the tapered portion 121 of the first telescoping rod 120. On the upper inner circumference of the widened portion 131, a step portion 132 is formed which is fixed to the locking projection 171 of the locking piece 170 to be described below.

In the lower end of the second telescoping rod 130, a cylindrical tip 150 is coupled, which is formed of such a material (metal or stone) as to give an impact at the time of hitting another person with the baton for self-protection.

In the upper portion of the handle 110 having the first and second telescoping rods 120 and 130 mounted to be sequentially telescoped, the locking piece fixing section 180 is inserted. The locking piece fixing section 180 is provided with a flange 181 projecting on the center of the outer circumference. The flange 181 comes in close contact with the inner circumference of the grip 112, and the lower circumference of the flange 181 comes in close contact with the upper inner circumference of the steel baton 111.

In the center of the locking piece fixing section 180, a locking piece insertion hole 182 is formed which passes through the upper and lower portions of the locking piece fixing section 180. Inside the insertion hole 182, the leaf-spring-shaped locking piece 170 is mounted. The locking piece 170 is provided with a pair of elastically-moving sections 172 which are formed by cutting the center portion of the locking piece 170. The locking piece 170 has a pair of locking projections 171 projecting on predetermined positions of both sides thereof.

At this time, the elastically-moving sections 172 of the locking piece 170 are mounted so as to elastically move inside the locking piece insertion hole 182, and the locking projections 171 of the locking piece 170 at both sides thereof are coupled so that the outer ends thereof are exposed outside the bottom surface of the locking piece fixing section 180.

The lower portion of the locking piece 170 is inserted and mounted into a locking piece inserting section 173 which comes in close contact with the bottom surface of the locking piece fixing section 180.

As such, the step portion 132 provided in the upper end of the second telescoping rod 130 housed in the handle 110 is locked to the locking projection 171 of the locking piece 170 mounted on the upper inner circumference of the handle 110, so that the first and second telescoping rods 120 and 130 are retracted and fixed.

In the upper end of the handle 110, a switch cap 161 as well as the switch 160 is mounted over the locking piece fixing section 180. In a state where the switch 160 is inserted into the switch cap 161, the switch cap 161 is coupled to the upper end of the handle 110 through the forcible insertion.

At this time, a tightening section 162 is formed to extend from the lower portion of the switch 160. As shown in FIG. 3, the tightening section 162 is inserted between the inner circumference of the locking piece inserting hole 182 and the elastically-moving section 172 so as to elastically move the elastically-moving section 172. Then, the locking of the second telescoping rod 130 with the locking piece 170 is released.

Inside the first telescoping rod 120 locked to the locking projection 171 of the locking piece 170, a spring 140 is mounted so as to elastically support the first and second telescoping rods 120 and 130 which have been sequentially telescoped. The spring 140 allows the first and second telescoping rods to be automatically drawn out. Further, the spring 140 is mounted while being compressed between the locking piece inserting section 173 and the tip 150 coupled to the lower end of the second telescoping rod 130.

FIGS. 5 and 6 are diagrams showing the expandable baton for self-protection of the present invention in the expanded position. Referring to the drawings, the coupling relationship between the components of the baton in the expanded position and the operation thereof will be described.

FIG. 5 is a perspective view showing the expandable baton for self-protection in the expanded position, and FIG. 6 is a sectional view showing the expandable baton for self-protection in the expanded position.

In the baton 100 for self-protection as shown in the drawings, the first and second telescoping rods 120 and 130, which have been retracted and housed in the cylindrical handle 110 covered by the grip 112, are elastically drawn out to the front side of the handle 110, when a locking force by the locking piece 170 is released.

The first and second telescoping rods 120 and 130 as well as the steel baton 111 coupled to the inner circumference of the handle 110 are fixed when the widened portions 122 and 131 and the tapered portion 121 are engaged so as to be in surface contact with each other.

At this time, as the locking of the first telescoping rod 120 is released, the spring 140 which has been compressed inside the handle 110 are extended across the handle 110 and the first and second telescoping rods 120 and 130, so that the respective components drawn toward the front of the handle 110 are elastically supported.

The operation of the expandable baton 100 for self-protection is performed as followed. First, one ends of the telescoping rods 120 and 130 elastically supported by the spring 140 are locked to the locking projection 171 of the locking piece 170 inside the handle 110. Then, the telescoping rods 120 and 130 are retracted and housed inside the handle 110, as shown in FIGS. 2 and 3A. In this state, if the switch 160 in one side of the handle 110 is pressed, the tightening section 162 of the switch 160 moves the elastically-moving section 172 of the locking piece 170 inwardly, so that the second telescoping rod 130 locked to the locking projection 171 of the locking piece 170 is released. Then, the first and second telescoping rods 120 and 130 are elastically drawn out toward the front of the handle 110 by the elasticity of the spring 140, so that the expandable baton 100 for self-protection is fully expanded.

The expandable baton 100 for self-protection, which has been extended in such a manner, is retracted by the following process. First, an external force larger than the elastic restoring force of the spring is applied to the end of the second telescoping rod 130 in a direction reverse to the direction where the telescoping rods are drawn out, so that the first and second telescoping rods 120 and 130 are sequentially retracted into the handle 110 and the upper step portion 132 of the second telescoping rod 130 is fixed to the locking projection 171 of the locking piece 170. Then, the expandable baton 100 for self-protection is completely retracted.

According to the present invention, the expandable baton for self-protection has such a structure that multiple telescoping rods supported by the spring inside the cylindrical handle are elastically drawn out. Therefore, the expandable baton for self-protection can be conveniently carried in the retracted state at normal times and can be effectively used for self-protection by a simple switch operation in an emergency.

Further, the switch for drawing out the telescoping rods is not positioned on the outer circumference of the handle, but is positioned in the opposite end of the expandable baton to the side where the telescoping rods are drawn out. Such a structure prevents the expandable baton from malfunctioning due to the contact when the expandable baton is kept in a handbag or used. Further, the appearance thereof is beautiful.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An expandable baton for self-protection comprising:

a handle of which the upper and lower ends are opened and which is formed of a steel baton having a tapered portion provided in the lower end thereof, the steel baton being covered by a grip;

first and second telescoping rods that are elastically supported by a spring mounted in a center portion of the handle and have different diameters respectively so as to be sequentially telescoped on an inner circumference of the steel baton in a longitudinal direction thereof inside the handle;

a locking piece formed of a leaf spring which is mounted so as to elastically move in a center portion of a locking piece fixing section inserted through an upper opening of the handle, the locking piece is mounted in a locking piece insertion hole passing through upper and lower portions of the locking piece fixing section, and has a pair of elastically-moving sections formed by cutting a center portion of the locking piece, the locking piece having a locking projection formed in both sides such that an insertion-side end of the second telescoping rod is locked thereto;

a switch built in a switch cap which is mounted over the locking piece fixing section so as to project above the handle, the switch being capable of moving the pair of elastically-moving sections of the locking piece inwardly so that the second telescoping rod locked to the locking projection of the locking piece is released.

2. The expandable baton for self-protection according to claim 1, wherein the first telescoping rod includes a widened portion, of which the diameter becomes gradually large, and a tapered portion, of which the diameter becomes gradually small, at both ends thereof.

3. The expandable baton for self-protection according to claim 2, wherein an upper portion of the second telescoping rod is formed with a widened portion of which the diameter becomes gradually large so that the widened portion is engaged with the tapered portion of the first telescoping rod, and the widened portion has a step portion formed on an upper inner circumference thereof.

4. The expandable baton for self-protection according to claim 2, wherein a lower end of the second telescoping rod is coupled to a cylindrical tip formed of a material having such a weight as to give an impact.

* * * * *